United States Patent [19]

Curran

[11] 4,404,906

[45] Sep. 20, 1983

[54] SYSTEM FOR CONTROLLING FAN-OUT IN A WEB OFFSET PRESS

[76] Inventor: Thomas F. Curran, 460 N. Main St., Wauconda, Ill. 60084

[21] Appl. No.: 264,634

[22] Filed: May 18, 1981

[51] Int. Cl.[3] ..... B41M 1/14

[52] U.S. Cl. ..... 101/211; 101/138; 101/180; 101/181; 101/225

[58] Field of Search ..... 226/88; 26/104; 101/181, 138, 139, 137, 180, 225, 211, 221, 228

[56] References Cited

U.S. PATENT DOCUMENTS

| | | | |
|---|---|---|---|
| 652,111 | 6/1900 | Jacobus | 101/181 |
| 1,638,560 | 8/1927 | Beveridge | 226/88 |
| 2,560,039 | 7/1951 | Harlow, Jr. | 26/104 |
| 2,689,392 | 9/1954 | Robertson | 26/104 |
| 3,470,592 | 10/1969 | Robertson | 26/104 |
| 3,641,933 | 2/1972 | Tafel | 101/181 |

*Primary Examiner*—Edgar S. Burr
*Assistant Examiner*—Charles A. Pearson
*Attorney, Agent, or Firm*—George H. Gerstman

[57] ABSTRACT

A system is provided for controlling fan-out in a web offset press. A bowed roller is interposed upstream of the blanket cylinder of the first printing unit. The bowed roller applies outward lateral forces to the web, to expand the web laterally prior to printing thereon by the blanket cylinder of the first printing unit.

2 Claims, 7 Drawing Figures

FIG. 4
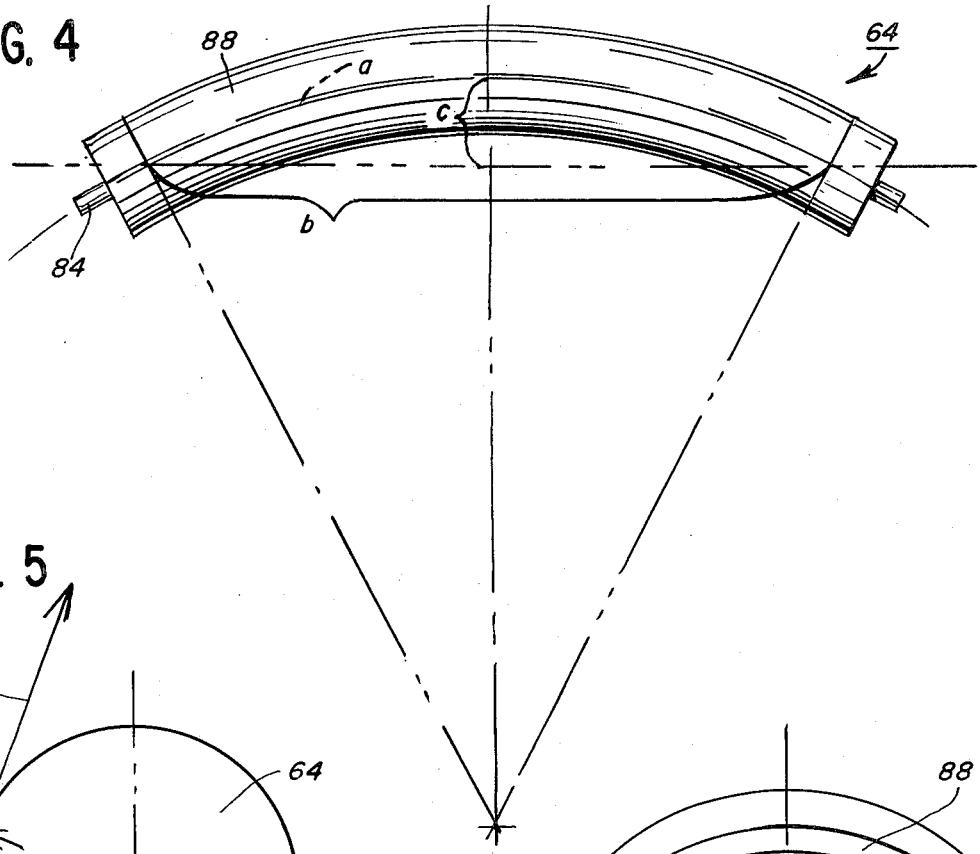
FIG. 5
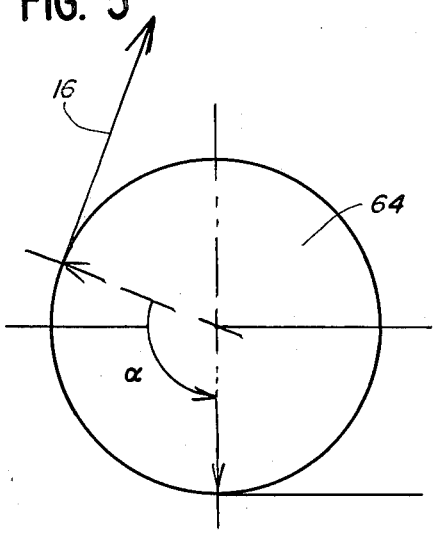
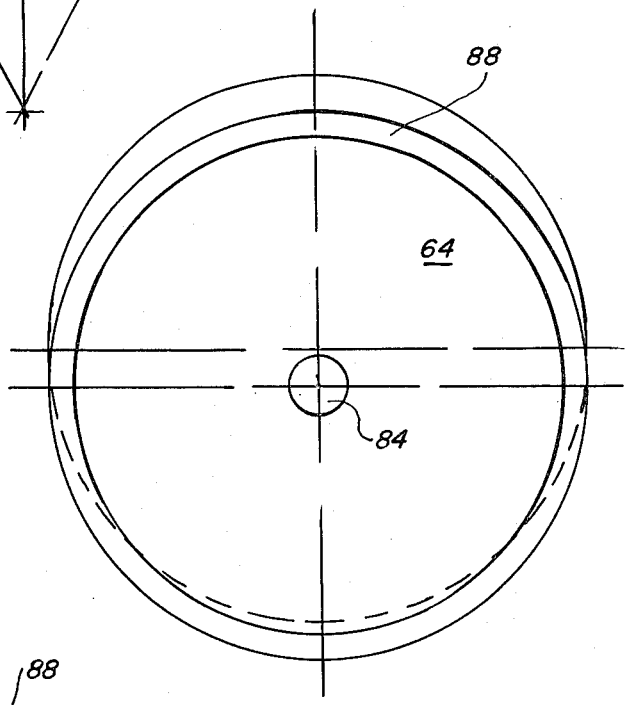
FIG. 7
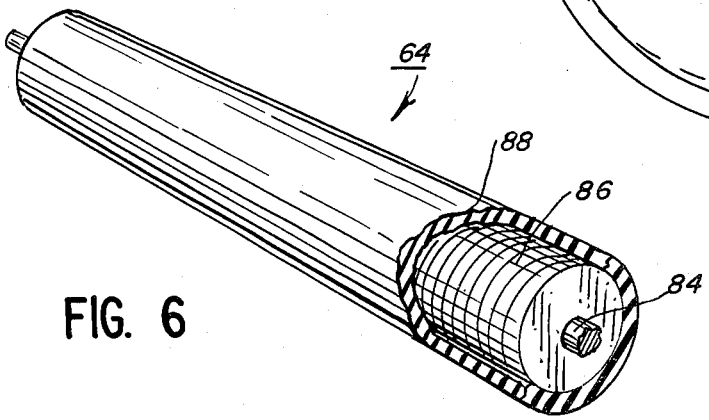
FIG. 6

SYSTEM FOR CONTROLLING FAN-OUT IN A WEB OFFSET PRESS

BACKGROUND OF THE INVENTION

The present invention concerns a system for preventing fan-out in a web offset press. "Fan-out" is a condition in which the color printed by the first printing unit is wider across the web than the colors printed by the subsequent printing units.

When the web leaves the feed roll, it is under relatively high longitudinal tension. Thus prior to entering between the blanket cylinders, the web is effectively laterally shortened. As the web enters the blanket cylinders of the first printing unit and the printing occurs, the web expands laterally. Thereafter, the printing of the other colors is on a web that has expanded laterally while the first color was being printed. Since the first printing is on paper that is slightly corrugated, when the paper expands laterally it will have a laterally larger image. This fan-out predominates on the first color, because after the first color is printed, the paper is acclimated to the press and it does not have the slightly corrugated nature that it had as it was fed into the blanket cylinders of the first printing unit.

Certain methods for solving the fan-out problem have been attempted. For example, in one prior art method the printing is accomplished on a proof, and the operator thereafter measures the fan-out and reduces the negative laterally for the first color. The first color plates are then remade, having smaller lateral dimensions in order to compensate for the fan-out. This method is relatively expensive in press made ready photography, press time and paper loss. In addition, it is uncertain that the next roll of paper will fan-out the same amount, and the method may have to be repeated for each roll of paper.

Another prior art method of attempting to correct the fan-out problem is the use of bustle wheels. To this end, a wheel (or wheels) is put under the printed web to reduce the lateral dimension of the web by placing a longitudinal corrugation or wave into the web. The use of bustle wheels requires constant adjustment, may puncture the web and the wheels may pick up ink and redistribute the ink.

Another prior art method of attempting to solve the fan-out problem is to extend the length of the web before it enters the first printing unit. However, this method by which the length of the web lead in the infeed section of the press is increased has not been found to be significantly effective in reducing fan-out.

It is, therefore, an object of the invention to provide a system for controlling fan-out which does not require remaking the first color plates, does not require bustle wheels and does not require an exceptionally long web lead in the infeed section of the press.

SUMMARY OF THE INVENTION

In accordance with the present invention, a system is provided for controlling fan-out in a web offset press. The press comprises a first printing unit including a plate cylinder and a blanket cylinder. Means are provided for applying ink to the plate cylinder and for delivering a web to the blanket cylinder. Means are provided upstream of the blanket cylinder for applying outward lateral forces to the web to expand the web laterally prior to printing thereon by the blanket cylinder.

It has been found that by applying outward lateral forces to the web to expand the web laterally prior to printing thereon by the blanket cylinder of the first printing unit, the first printed color is not wider across the web than subsequent printed colors.

In the illustrative embodiment, the lateral forces applying means comprises a bowed roller interposed transverse the web, upstream of the blanket cylinder. The bowed roller comprises a roller having a generally resilient surface and a bow that is no greater than 0.1 percent. The bowed roller is positioned with respect to the web to provide a wrap angle between 60° and 180°.

A more detailed explanation of the invention is provided in the following description and claims, and is illustrated in the accompanying drawings.

BRIEF DESCRIPTION OF THE DRAWINGS

FIG. 4 is an elevational view, in exaggerated form for clarity, of a fan-out control roller, constructed in accordance with the principles of the present invention;

FIG. 5 is a diagram showing a wrap angle as used in connection with the present invention;

FIG. 6 is a perspective view, with portions cut away for clarity, of a fan-out control roller constructed in accordance with the principles of the present invention; and FIG. 7 is an end view of a fan-out control roller constructed in accordance with the principles of the present invention.

DETAILED DESCRIPTION OF THE ILLUSTRATIVE EMBODIMENT

Figure 1:
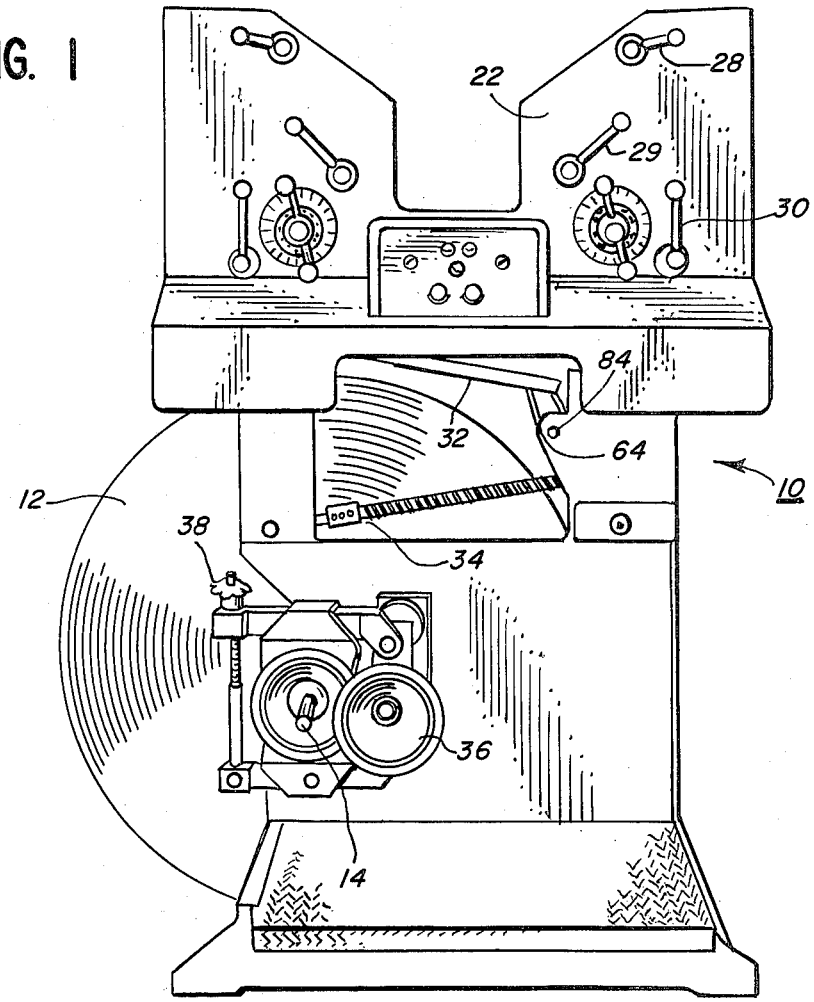
FIG. 1 is a side elevational view of a web offset press constructed in accordance with the principles of the present invention.

Referring to the drawings, in FIG. 1 a web offset press 10 is illustrated and may comprise any web fed offset press such as a conventional Rockwell-Goss Community press which has been modified to include means upstream of the blanket cylinder for applying outward lateral forces to the web to expand the web laterally prior to printing thereon by the blanket cylinder.

Thus infeed roll 12 carried on shaft 14 comprises web 16 which is fed through the blanket cylinders 18, 20 (FIGS. 2 and 3) located within side members 22. Also located within the side members are plate cylinders 24 and 26, and other rollers to be described. As is conventional, the press 10 includes ink feed roller throwoff 28, ink form roller throwoff 29, dampener form roller throwoff 30, blanket cylinder throwoff 32, a tension control nut 34, a hand wheel 36 and a brake shoe hand wheel 38.

Figure 2:
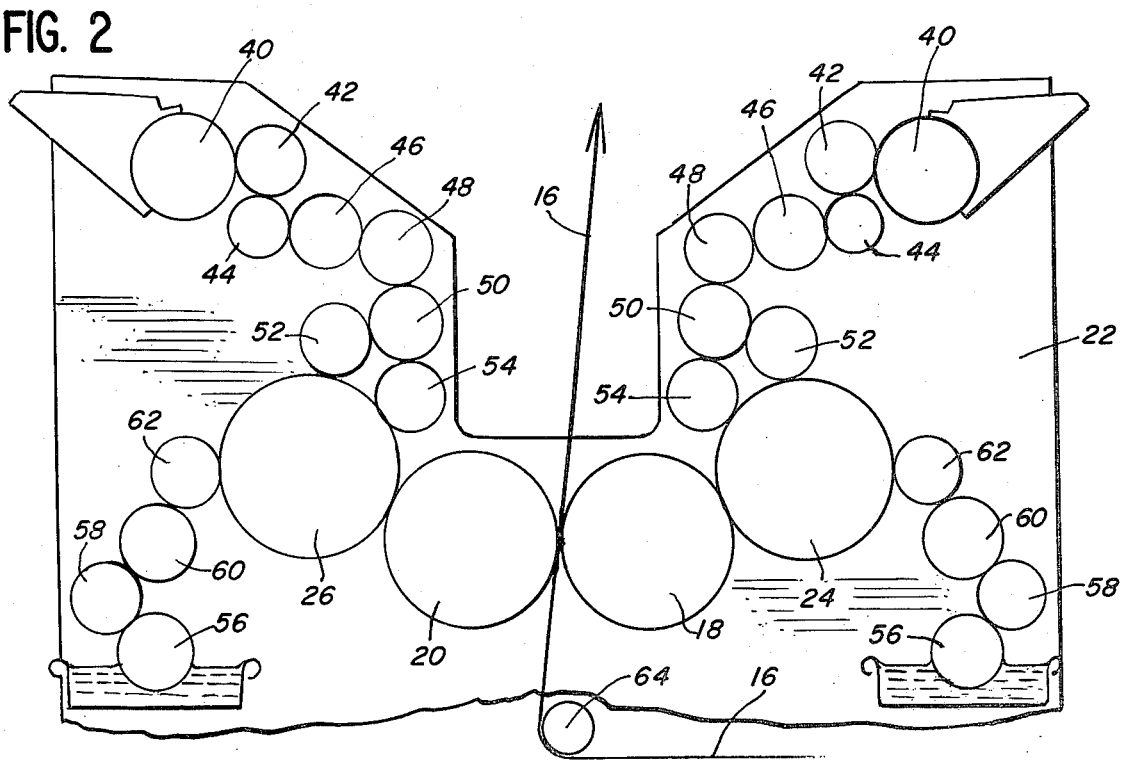
FIG. 2 is a diagrammatic view of the printing portion of the press of FIG. 1, showing the arrangement of rollers.

Referring to FIG. 2, it can be seen that the press includes ink fountain rollers 40, ink feed rollers 42, ink transfer rollers 44, vibrated drum rollers 46, ink transfer rollers 48, vibrated drum rollers 50, ink form rollers 52, ink form rollers 54, dampener fountain rollers 56, dampener feed rollers 58, vibrated drum rollers 60 and dampener form rollers 62.

In order to control fan-out, a bowed roller 64 is interposed transverse web 16, upstream of blanket cylinders 18, 20.

Figure 3:
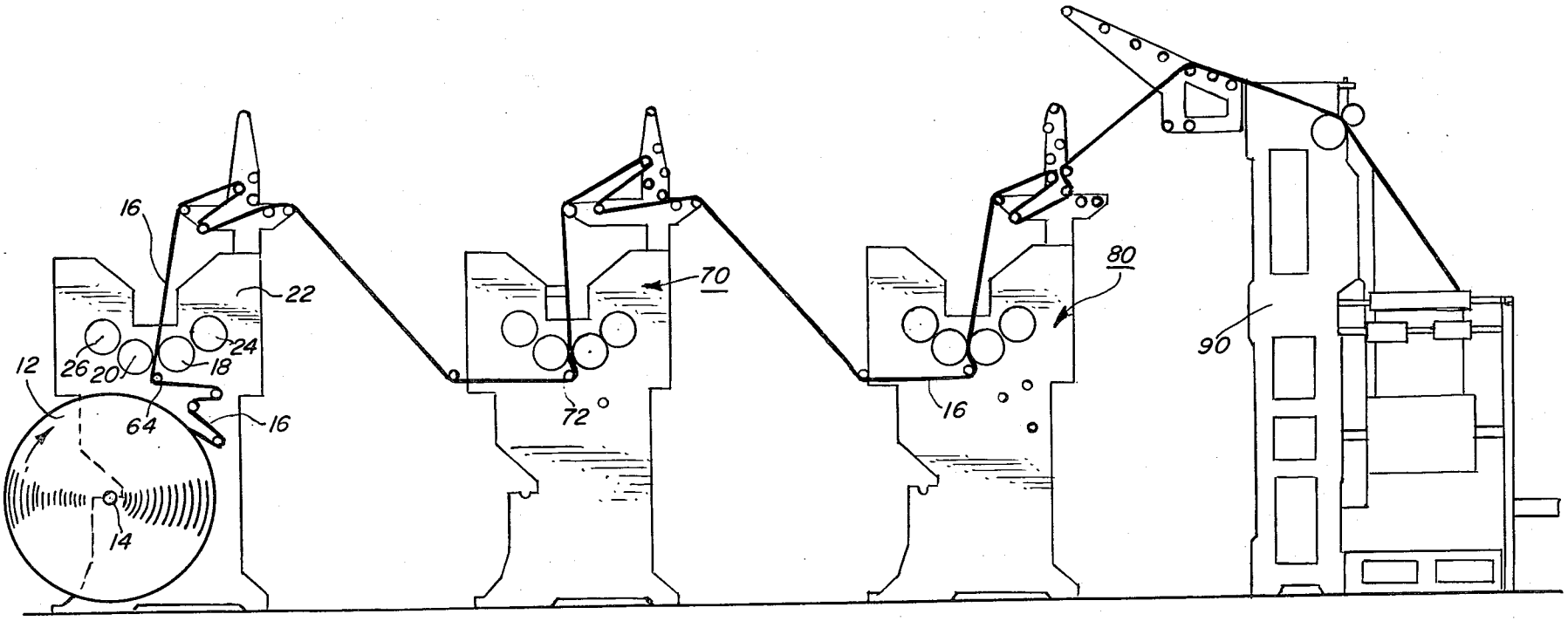
FIG. 3 is a diagrammatic view of a three-color press system constructed in accordance with the principles of the present invention.

In FIG. 3, press 10 of FIG. 1 is illustrated as the first printing unit, through which the first color is printed on web 16 from infeed roller 12. Second printing unit 70 is substantially identical to first printing unit 10, but the second printing unit does not have bowed roller 64 for applying outward lateral forces to the web. Instead, the second printing unit 70 uses a straight axis idler roller 72, as is conventional, with the straight axis roller 72 not having the capability of applying outward lateral forces to the web. The second color is printed onto web 16 by the blanket cylinders of the second printing unit 70.

Likewise, the third color is printed onto the web 16 by the blanket cylinders of the third printing unit 80. The third printing unit 80 is identical to the second printing unit 70.

After printing has occurred, the web is fed to station 90 for further processing, as is conventional in the printing art.

Fan-out control roller 64 is a roller which, as stated above, is bowed in a manner which applies outward lateral forces to the web to expand the web laterally. In order to apply the proper amount of lateral forces to the web, it is important that the percentage of bow be no greater than 0.1 percent, and it is preferred that the percentage of bow be between about 0.02 percent to about 0.08 percent. In an illustrative embodiment, although no limitation is intended, the specific percentage of bow is 0.06 percent.

In order to determine the percentage of bow, reference is made to FIG. 4. A horizontal line b is drawn through the axis of the shaft to form a chord of a circle having an arc a, which is the portion of the shaft between the two intersections of the chord b and the shaft. The radial distance of the chord b from the arc a at its greatest distance is designated c. The percentage of bow is equal to 100 X c divided by b. For example, if b is equal to 36 inches and c is equal to 0.02 inch, the percentage of bow will be 0.0555.

Fan-out control roller 64 includes a central shaft 84 encircled by a number of bearings 86. Bearings 86 are covered with a resilient sheath 88 formed of rubber, urethane or neoprene. Since the resilient sheath is uniform in thickness, the bowed roller can be described as a roller having a generally resilient surface that forms the arc of a circle, with the chord defining the arc being at least 1,000 times longer than the portion of the radius of the circle which extends from the chord to the arc. If the chord is 1,000 times longer than the portion of the radius of the circle extending from the chord to the arc, the percentage of bow will be 0.1 percent. If the chord defining the arc is 2,000 times longer than the portion of the radius of the circle which extends from the chord to the arc, the percentage of bow will be 0.05 percent.

In order for the proper outward lateral forces to be applied to the web to prevent fan-out, it is also important that bowed roller 64 be positioned with respect to web 16 to provide a wrap angle of between 60° and 180°. In an illustrative embodiment, the bowed roller is positioned with respect to the web at a wrap angle of approximately 90°.

To determine the "wrap angle", reference is made herein to FIG. 5 of the drawings. The "wrap angle" is angle $\alpha$, which describes the arc of the circumference of roller 64 which contacts web 16.

It is seen that a system has been provided for controlling fan-out in a web offset press, utilizing a bowed roller to apply outward lateral forces to the web to expand the web laterally prior to its entry into the blanket cylinder. By utilizing a bowed roller having a generally resilient surface and a bow that is no greater than 0.1 percent, and also utilizing a wrap angle of between 60° and 180°, the web will be in a condition as it is printed on by the blanket cylinders 18, 20 that it is substantially identical to the condition when it is printed on by the blanket cylinders of the second and third printing units 70 and 80. Thus the first color that is printed on the web by printing unit 10 will now be wider across the web than the colors which are subsequently printed by printing units 70 and 80.

Although an illustrative embodiment of the invention has been shown and described, it is to be understood that various modifications and substitutions may be made by those skilled in the art without departing from the novel spirit and scope of the present invention.

What is claimed is:

1. A method for controlling fan-out in a web offset press, which comprises the steps of:

providing first, second and third printing units, each of which printing units includes a plate cylinder and a blanket cylinder;

applying ink to the plate cylinders;

delivering a web to the blanket cylinders;

interposing, at a wrap angle of between 60° and 180°, a bowed roller, having a bow that is between 0.02 percent and 0.08 percent, transverse the web immediately upstream of the blanket cylinder of the first printing unit only without any tensioning device intermediate the bowed roller and the blanket cylinder, prior to delivery of the web to the blanket cylinder of the first printing unit, for applying outward lateral forces to the web to expand the web laterally prior to printing thereon by the blanket cylinder of the first printing unit.

2. A method for controlling fan-out in a web offset press, which comprises the steps of:

providing a plurality of printing units each including a plate cylinder and a blanket cylinder;

applying ink to the plate cylinders;

delivering a web to the blanket cylinders;

interposing, at a wrap angle of between 60° and 180°, a bowed roller, having a bow that is between 0.02 percent and 0.08 percent, transverse the web immediately upstream of the first blanket cylinder without any tensioning device intermediate the bowed roller and the first blanket cylinder, for applying outward lateral forces to the web to expand the web laterally prior to printing thereon by the first blanket cylinder.

* * * * *